United States Patent [19]

Huh

[11] Patent Number: 4,505,078

[45] Date of Patent: Mar. 19, 1985

[54] BEDROOM CABINET

[76] Inventor: Phil-yool Huh, 5-8, Nakamachi 1-Chome, Musashino-shi, Tokyo, Japan

[21] Appl. No.: 538,860

[22] Filed: Oct. 4, 1983

[30] Foreign Application Priority Data

Oct. 7, 1982 [JP] Japan ..... 57-175374

[51] Int. Cl.[3] ..... A47G 29/02

[52] U.S. Cl. ..... 52/36; 312/242; 312/284

[58] Field of Search ..... 128/1 B; 312/284, 31, 312/290, 297, 242, 239, DIG. 33; 220/4 B; 52/36

[56] References Cited

U.S. PATENT DOCUMENTS

| | | | |
|---|---|---|---|
| 1,784,516 | 12/1930 | Fairbanks | 220/4 B |
| 2,235,454 | 3/1941 | Koropchak | 312/297 |
| 2,603,549 | 7/1952 | Tessmer et al. | 312/284 |
| 4,040,691 | 8/1977 | David et al. | 312/31 |
| 4,395,785 | 8/1983 | Huh | 5/2 R |

*Primary Examiner*—William E. Lyddane
*Assistant Examiner*—Joseph Falk
*Attorney, Agent, or Firm*—Jordan and Hamburg

[57] ABSTRACT

A bedroom cabinet having a floor area at least approximately equal to an area of a bed and a height such that a user can erect the upper half of his body on the bed. This cabinet is composed of two layers, that is, an outer casing and an inner casing, the outer casing being divided into an upper casing and a lower casing, and a recess serving as an accommodating shelf for electric devices and a user's belongings is provided in the side wall of the inner casing so as to be projected outwardly. This projection of the recess is projected into a clearance between the outer casing and the inner casing, and the projection of the recess is formed so as not to be further projected from the outer periphery of the outer casing, the clearance being used as a wiring passage for electric devices and as vent passage for ventilation.

20 Claims, 9 Drawing Figures

FIG. 6
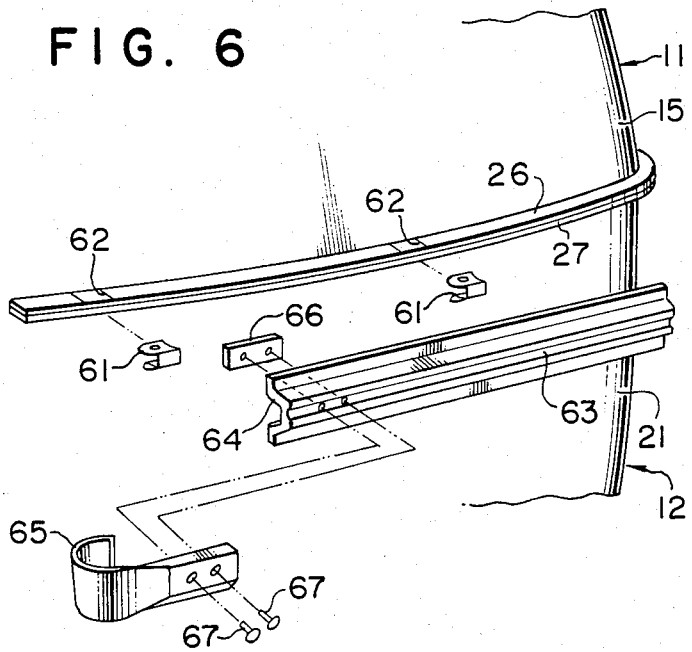
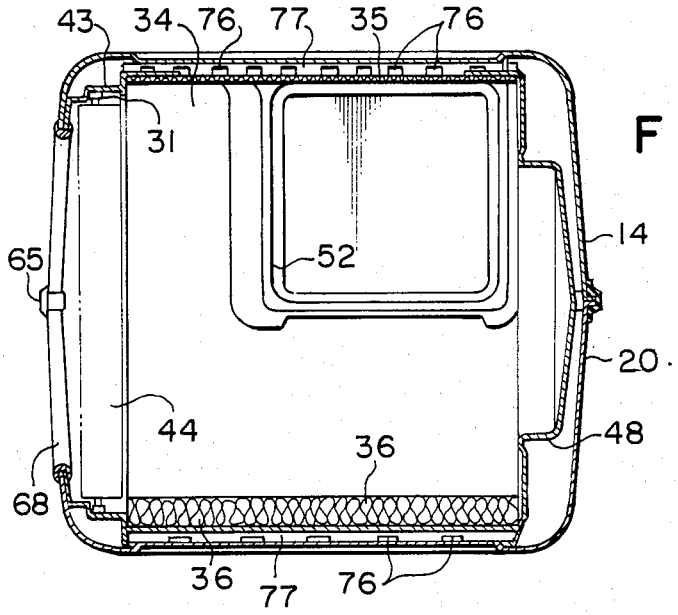
FIG. 8

BEDROOM CABINET

FIELD AND BACKGROUND OF THE INVENTION

The present invention relates to a bedroom cabinet, and more specifically, to a unit type bedroom cabinet which is optimum to provide a flophouse facility comprising a number of individual rooms on the floor of an existing building.

There have been heretofore proposed unit type bedroom cabinets used as a flophouse requiring no bath room or a flophouse for taking a nap. This bedroom cabinet is designed so that it has a floor area at least approximately equal to an area of a bed, has a height such that a user can erect the upper half of his body on the bed, and has the circumference completely shut off from the outside except a doorway. Such a bedroom cabinet can be carried afer it has been assembled and completed and can be simply installed for workmen's quarters or a stadium in a site of construction. In this case, since of course a plurality of bedroom cabinets can be arranged in a plane on the floor of the building and one bedroom cabinet can be stacked on the other, many workmen can be received in a limited floor area for rest. Fixing one's eyes upon this advantage, an attempt has been also made to provide a flophouse in which a number of bedroom cabinets as described above are installed for users to take a nap at at low charges.

DESCRIPTION OF THE PRIOR ART

Such a bedroom cabinet is disclosed, for example, in U.S. Pat. No. 4,395,785 invented by the inventor of the present application. This bedroom panel is assembled in the box-shape by six single layer panels, that is, a bottom panel, a ceiling panel, a front panel, a back panel, a left side panel and a right side panel. The front panel is provided with an opening for an exit, and the bottom panel has a mat thereon. Within the cabinet are projectingly provided an inclined portion which serves as a backrest when a user sits on the mat, a box for accommodating therein a TV receiver, and a box used for accommodating therein an interphone or a radio receiver. The box for a TV receiver can be provided at an upper corner within the cabinet, thus posing no problem, but the box for an interphone is provided at a lower position to which user is easily accessible. Thus, if a protruded portion is provided at the lower portion of the cabinet, a dwelling area is reduced through that amount. The bedroom cabinet is composed of single layer panels and a vent is provided on the panel which serves as a side wall surface. Therefore, the side wall portion is likely to be decreased in strength and in addition there has been encountered a problem in terms of sound-proof.

In this case, there is an idea such that the box is projected from the outer peripheral surface of the cabinet so as not to narrow the dwelling area. However, the provision of a portion projected from the outer periphery of the cabinet makes it necessary to provide a clearance through that projected portion and in addition deteriorates an external appearance, where a plurality of cabinets are stacked or installed adjacent to each other.

SUMMARY OF THE INVENTION

It is therefore an object of the present invention to overcome these disadvantages noted above with respect to conventional bedroom cabinets and provide a bedroom cabinet in which the external surfaces thereof are formed to be flat.

It is a further object of the invention to provide a bedroom cabinet in which shelves for accommodating therein a user's belongings and a box for accommodating therein devices such as an interphone can be provided within the cabinet without being projected therein and without being projected from the outer periphery of the bedroom cabinet.

In accordance with the present invention, there is provided a bedroom cabinet formed into a box-shape by a hexahedron consisting of four side surfaces, an upper surface and a lower surface, comprising an outer casing composed of upper and lower outer casings, the upper outer casing having front and rear side portions, left and right side portions and an upper surface portion integrally formed, the front side portion being formed with a notch portion corresponding to the upper half of an exit, the lower outer casing having front and rear side portions, left and right portions and a lower surface portion integrally formed, the front surface portion being formed with a notch portion corresponding to the lower half of the exit; an inner casing positioned within the outer casing and comprising a front surface panel, a back panel, left and right side panels, a ceiling panel and a bottom panel, the front surface panel having an opening in communication with the notches of the upper and lower outer casings and having an area approximately equal to the exit, the bottom panel having a mat thereon, wherein a peripheral edge at the lower end of the upper outer casing and a peripheral edge at the upper end of the lower upper casing are respectively formed with outwardly projected flanges, and the outer casing is assembled in such a way that the flange of the upper outer casing is brought into abutment with the flange of the lower outer casing.

The bedroom cabinet of the present invention is of the dual construction comprising the outer casing and the inner casing, and therefore it is excellent in mechanical strength. In addition, by providing a clearance is formed between the outer casing and the inner casing a box in which electric devices such as an illuminating instrument, an interphone or the like is mounted or a box which serves as a shelf for accommodating therein a user's belongings can be formed in this clearance, and therefore such boxes will not be projected within the cabinet and from the outer periphery of the outer casing. Accordingly, the dwelling area can be effectively utilized, and since the external surfaces of the cabinet are formed to be flat, a plurality of bedroom cabinets can be closed stacked or installed adjacent to each other. The clearance between the outer and inner casings used to form a box can house therein wirings or the like for interior electric devices.

The present invention further provides a bedroom cabinet wherein a clearance between an outer casing and an inner casing is formed over the whole periphery, and spacer members are interposed in the clearance in a suitably spaced relation, the spacer member being formed with a venting groove. Thereby, an uniform air flowpassage is formed in the outer periphery of the inner casing whereby natural ventilation within a room can be carried out smoothly, and sound-proofing effect can be also increased.

BRIEF DESCRIPTION OF THE DRAWINGS

FIG. 6 is a perspective view, in an exploded form, showing a joint between an upper outer housing and a lower outer housing.

FIG. 8 is a sectional view taken on line 8—8 of FIG. 7.

DESCRIPTION OF THE PREFERRED EMBODIMENTS

Figure 1:
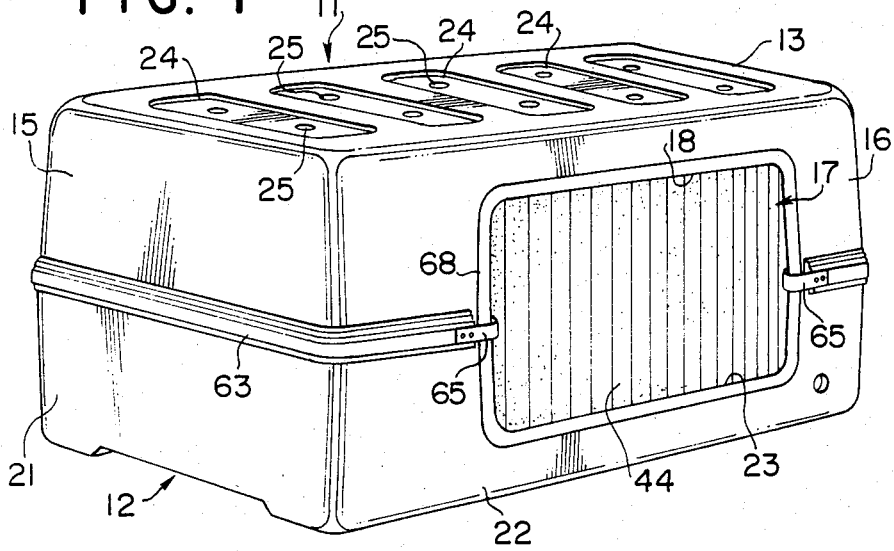
FIG. 1 is a perspective view showing one embodiment of a bedroom cabinet in accordance with the present invention.

One embodiment of a bedroom cabinet of the present invention shown in FIGS. 1 through 6 will be described. A bedroom cabinet has an upper outer housing 11 and a lower outer housing 12 which are integrally formed of a fiber reinforced plastic (FRP) or the like. The upper outer housing 11 has an upper surface portion 13, a back surface portion 14, left and right side surfaces 15 and a front portion 16, the front portion 16 being formed with a notch portion 18 for forming the upper half of an exit 17. The lower outer housing 12 has a lower surface portion 9, a back surface portion 20, left and right side surfaces 21 and a front portion 22, the front portion 22 being formed with a notch portion 23 for forming the lower half of the exit 17. The upper surface portion 13 and back surface portion 14 of the upper outer housing 11 and the lower surface portion 19 and back surface portion 20 of the lower outer housing 12 are respectively formed with a plurality of recesses 24 having a required width, and the recess 24 in the upper surface portion 13 of the upper outer housing 11 is formed with a number of venting through-holes 25 in a suitably spaced relation. A peripheral edge at the lower end of the upper outer housing 11 and a peripheral edge at the upper end of the lower outer housing 12 are respectively formed with horizontally outwardly projecting flanges 26, 27 so that when the upper outer housing 11 is placed on the lower outer housing 12, these flanges 26, 27 are placed in abutment with each other.

Figure 3:
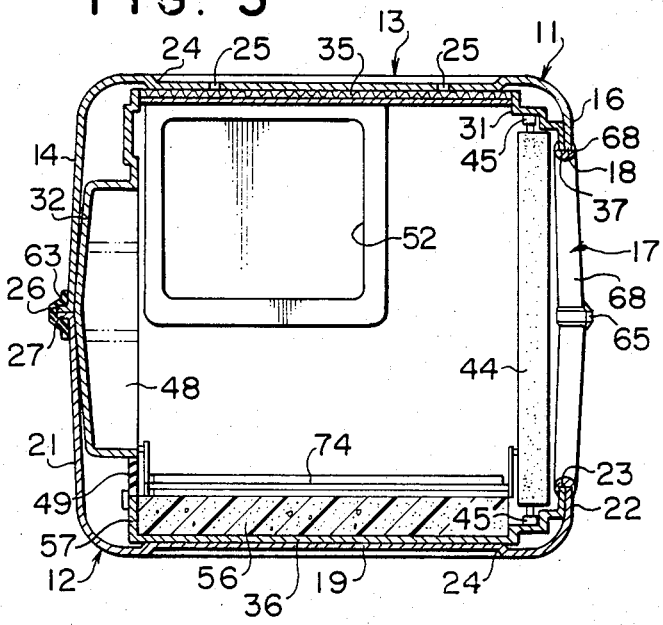
FIG. 3 is a sectional view taken on line 3—3 of FIG. 2.
Figure 2:
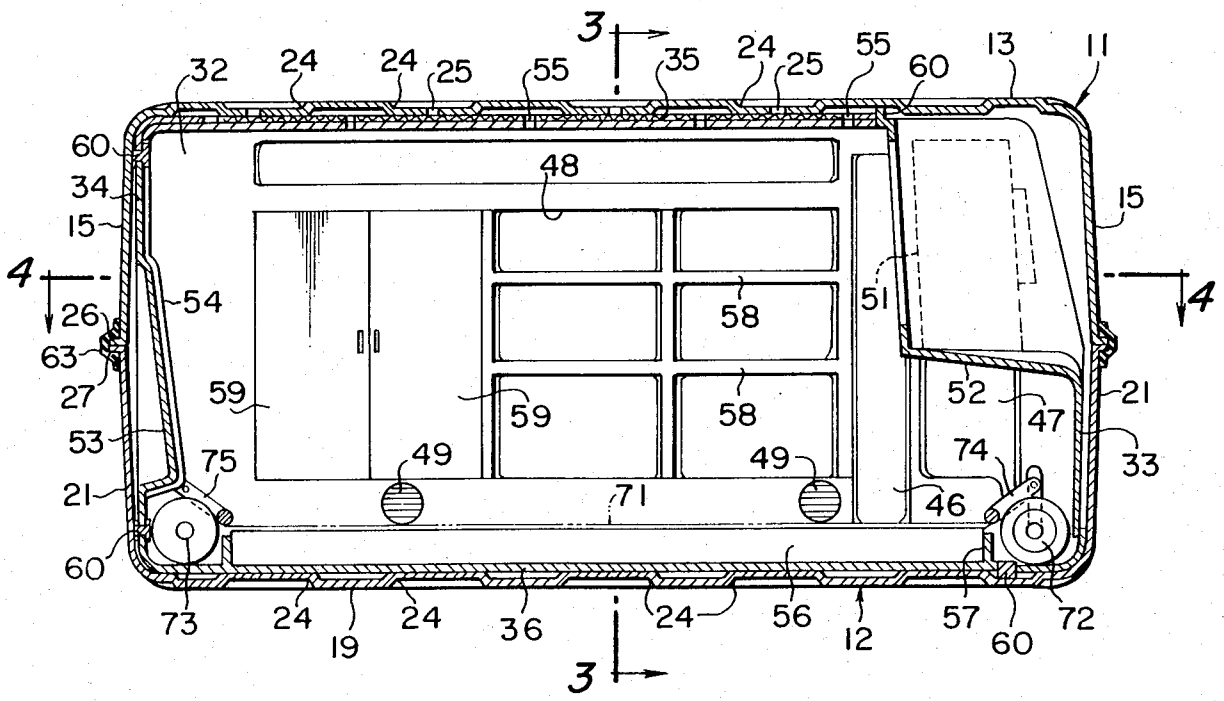
FIG. 2 is a front view in longitudinal section of the bedroom cabinet of FIG. 1.
Figure 4:
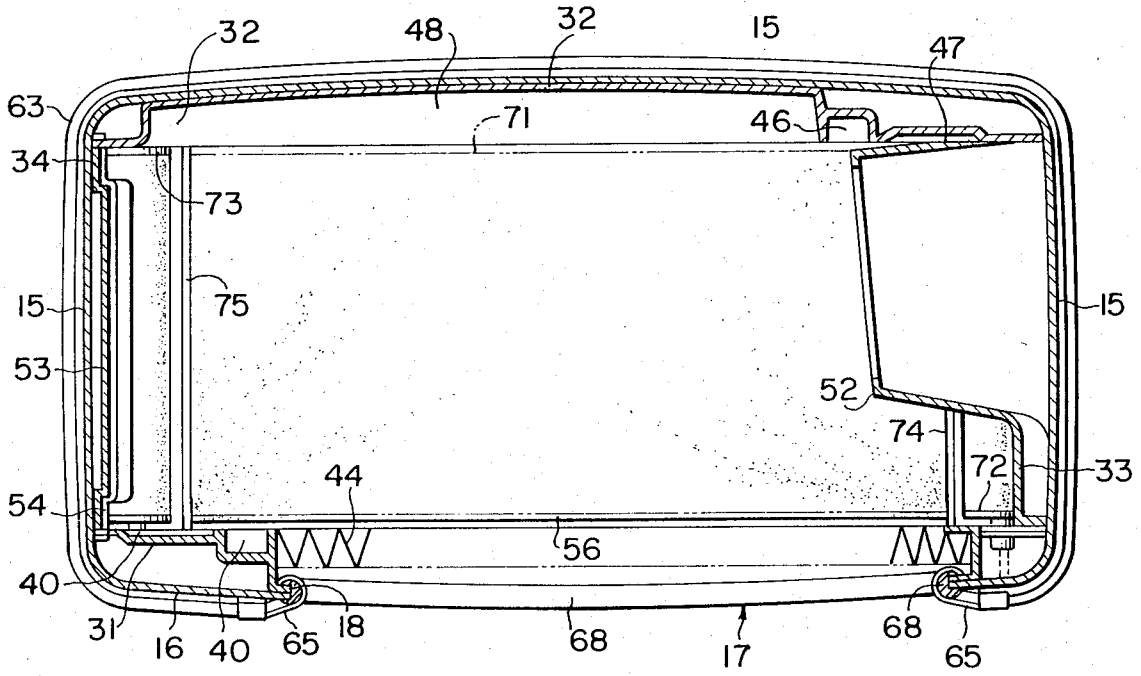
FIG. 4 is a sectional view taken on line 4—4 of FIG. 2.
Figure 5:
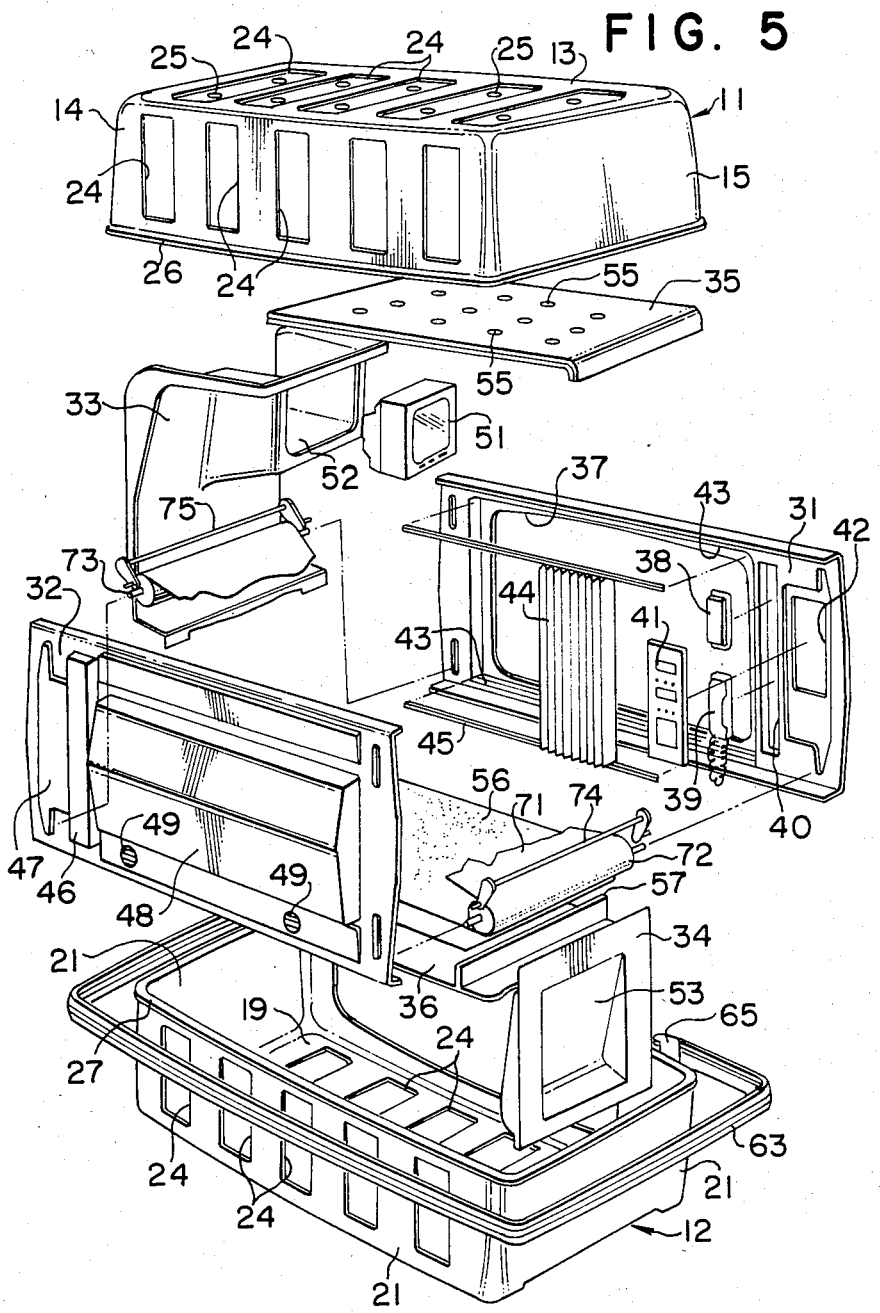
FIG. 5 is a perspective view showing the bedroom cabinet of FIG. 1 in an exploded form.

The upper and lower outer housings 11 and 12 are internally provided with an inner casing 2 comprising a front panel 31, a back panel 32, a right side panel 33, a left side panel 34, a ceiling panel 35 and a bottom panel 36, totalling to six panels. The front panel 31 positioned on the side of the exit 17 is provided with an opening 37 corresponding to the exit 17, as shown in FIGS. 4 and 5. One surface adjacent to the opening 37 is formed with a box 40 in which an illuminating device 38 or an interphone 39 is mounted and a box 42 in which a device 41 such as a clock or a radio receiver is mounted. These boxes 40 and 42 are formed to be projected outwardly. Upper and lower ends of the front panel 31 are inwardly bent to form a flange 43 on which is mounted a curtain rail 45 for a curtain 44 to block the exit 17. The back panel 32 is formed with boxes 46 and 47 similar to the boxes 40 and 42 and a box 48 constituting an accommodating shelf, as shown in FIGS. 2 through 5, and is formed at its lower portion with a plurality of vent holes 49. These boxes are also formed to be projected outwardly. It is noted that the boxes 46 and 47 can be also used for installation of devices which cannot be accommodated within the boxes 40 and 42 on the front panel 31 or can be used as arranging shelves. The right side panel 33 has a shelt 52 for accommodating therein a TV receiver 51, as shown in FIGS. 2 through 5, and the shelf 52 is formed to be projected inwardly. The left side panel 34 is formed with an inclined portion 53 which is useful as a backrest when a user rests in the bedroom cabinet, as shown in FIGS. 2, 4 and 5, and a cushion 54 is stuck to the surface of the inclined portion. The ceiling panel 35 has for example expanded styrol and urethane laminated to provide sound-proofing effect. The ceiling panel 35 is formed with a number of vent holes 55 in a suitably spaced relation. Finally, the bottom panel 36 is formed with a rim 57 used to fix a mat 56, as shown in FIGS. 2, 3 and 5. The box 48 of the back panel 32 is provided with a plurality of shelt plates 58 and an accommodating section with a door 59 that may be used for a locker or the like. Of course, this box 48 can be used as a mere box with the shelf plates 58 and the door 59 removed.

While adjacent end edges of each of the panels 31 to 36 are connected and fixed by seals 60, it should be noted that the seal 60 is not always necessary but a fit-in type groove can be formed in each end edge so that they are connected by said groove.

Next, assembling of the bedroom cabinet will be described. First, the lower half of the inner casing composed of the panels 31 to 36 connected and fixed as described above is received into the lower outer casing 12. It is of course at this time that the inner casing is fitted into the lower outer casing 12 in such a way that the notch portion 23 of the front portion 12 of the lower outer casing 12 is registered with the lower half of the opening 37 of the front panel 31. Next, the upper outer casing 12 is fitted in such a way that the notch portion 18 thereof is registered with the upper half of the opening 37 of the front panel 31, and the flange 26 is brought into abutment with the flange 27 of the lower upper casing 12. These two flanges 26 and 27 are resiliently held by a clip member 61 formed from a resilient metal plate, as shown in FIG. 6 in detail. Preferably, a recess 62 is formed in portions of the flanges 26 and 27 held by the clip member 61 to prevent the clip member 61 from being deviated in a lateral direction. An ornamental web 63 formed of an expansible material such as rubber or synthetic resin is wound so as to cover the flanges 26 and 27. This web 63 is formed at its inner surface with an escape groove 64 for the flanges 26 and 27, and on both ends thereof are mounted hooks 65 to be engaged with the end edge of the exit 17. The hook 65 is secured to be web 63 by inserting and locking a screw 67 to a stop plate 66 provided on the rear surface of the end of the web 63 therethrough. The exit 17 with which the hook 65 is engaged by superposition of the notches 18 and 23 of the upper and lower outer casings 11 and 12 and the opening 37 of the front panel 31, and an edge frame 68 formed of an elastic material is mounted so as to bridge over both peripheral edges of the notches 18, 23 and opening 37. Thus, the hook 65 is passed over the edge frame 68.

Articles such as a TV receiver 51 are mounted within the thus assembled bedroom cabinet. In this case, if various electric devices such as a TV receiver 51, an interphone 39 and the like are mounted under the condition that the inner casing is fitted and fixed within the lower outer casing 12, wiring work to the outside of the inner casing can be achieved easily.

As shown in FIGS. 2 to 5, in the above-described embodiment, a sheet 71 to cover the mat 36 is in the form of a web in which both ends thereof are wound by winding rollers 72 and 73, a dirty sheet 71 can be wound on one roller by rotating the winding rollers 72 and 73 in one direction. The sheet 71 is pressed against the mat by keep members 74 and 75 provided in the neighbourhood of each of the winding rollers 72 and 73.

Figure 7:
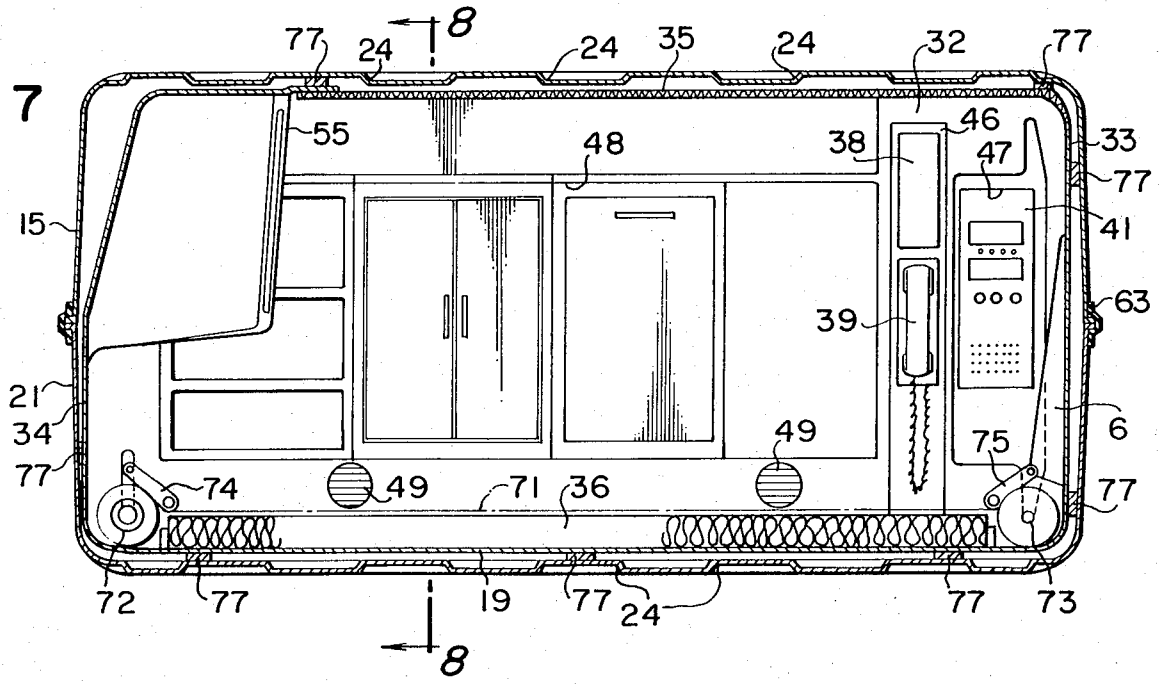
FIG. 7 is a front view in longitudinal section showing a further embodiment of the present invention.
Figure 9:
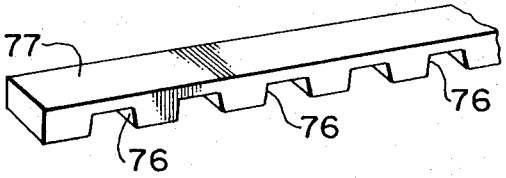
FIG. 9 is a perspective view showing a part of a spacer.

Next, a second embodiment of the bedroom cabinet of the present invention shown in FIGS. 7 through 9 will be described. The same elements in this embodiment as those in the above-described first embodiment bear the same reference numeral, the details of which will not be described. In the second embodiment, the desired clearance over the approximately entire portion is provided between the upper and lower outer casings 11, 12 and the inner casing composed of six panels 31 to 36.

That is, the upper and lower outer casings 11 and 12 are formed to be somewhat large or the inner casing is formed to be somewhat small, whereby a clearance over the approximately entire portion can be formed between the outer casings 11, 12 and the inner casing. Spacer members 77 each having a vent groove 76 are interposed and locked between the inner surfaces of the upper and lower outer casings 11, 12 and the panels 31 to 36 opposed to the upper and lower inner surfaces thereof. The spacer member 77 can be different in strength depending on the position disposed. That is, the spacer member 77 interposed between the lower surface 19 of the lower outer casing 12 and the bottom panel 36 is subjected to the approximately entire load of six panels 31 to 36, loads of various devices provided and the user's weight, and therefore, it is formed of a material having a great strength. On the other hand, the spacer member 77 interposed between the upper surface 13 of the upper outer casing 11 and the ceiling panel 35 can be supported under the condition that the celing panel 35 is suspended to maintain its clearance, and therefore, a small strength thereof will suffice. Further the spacer members 77 respectively interposed between the side, front and back surfaces of the outer casings 11, 12 and the side panels 33, 34, the front panel 31 and the back panel 32 may have an intermediate strength between the spacer member between the uper surface portion 13 and the ceiling panel 35, and the spacer member between the lower surface portion 19 and the bottom panel 36.

As described above, in the second embodiment, a spacer member 77 having the required strength is interposed between the outer casings 11, 12 and the interior body to form a clearance in communication as a whole. This clearance acts as an intake and exhaust passage in communication with the vent hole 49 and with the vent hole 55 of the ceiling panel 35 and also serves as a sound-proofing wall. In this second embodiment, an inclined portion 53 is provided on the right side panel 33 and a box 52 for a TV receiver is provided on the left side panel 34. An illuminating device 38, an interphone 39 and a device 41 are mounted on the boxes 46 47 of the back panel 32.

What is claimed is:

1. A bedroom cabinet for accommodating a prone person and providing an enclosed bedroom for said person, comprising an outer casing in the form of a hexahedron, said outer casing having an upper half and a lower half, said upper casing half having front and rear walls, right and left walls, and a top wall, said lower casing half having front and rear walls, right and left walls and a bottom wall, fastening means joining said upper and lower casing halves to form said hexahedron, said front wall of each of said upper and lower casing halves having opposed notched areas which together form an access opening for said person, an inner casing disposed within said outer casing, said inner casing comprising a front panel, rear panel, right panel and left panel disposed inwardly of said front wall, rear wall, right wall and left wall respectively of said upper and lower inner casing halves, said inner casing further comprising a ceiling panel disposed inwardly and underlying said top wall of said upper casing half and a floor panel disposed inwardly and overlying said bottom wall of said lower casing half, said front panel having an opening aligned with and having substantially the same configuration as said access opening in said outer casing, a mat on said botom panel accommodating said prone person, said inner casing having portions thereof contacting said outer casing such that the overall structural integrity of the bedroom cabinet is increased, said inner casing having portions thereof spaced from said outer casing and providing recesses accessible to said person from the inside of said bedroom cabinet.

2. A bedroom cabinet according to claim 1, wherein said inner casing has sections thereof spaced from said outer casing defining clearance spaces, and a plurality of spacer members disposed in said clearance spaces, said plurality of spacer members being spaced from one another.

3. A bedroom cabinet according to claim 2, wherein at least some of said spacer members are provided with a least one venting groove.

4. A bedroom cabinet according to claim 1, wherein said inner casing is provided with at least one venting opening.

5. A bedroom cabinet according to claim 1, wherein said outer casing is provided with at least one venting opening.

6. A bedroom cabinet according to claim 1, wherein said upper and lower casing halves each have a peripheral edge with an outwardly projecting flange which abut one another, said fastening means comprising clip members holding said abutting flanges together, said clip members being made of metal.

7. A bedroom cabinet according to claim 6, further comprising an expandable web disposed about said abutting flanges.

8. A bedroom cabinet for accommodating a prone person and providing an enclosed bedroom for said person, comprising an outer casing in the form of a hexahedron, said outer casing having an upper half and a lower half, said upper casing half having integrally formed front and rear walls, right and left walls, and a top wall, said lower casing half having integrally formed front and rear walls, right and left walls and a bottom wall, said upper casing half having a peripheral edge portion formed as a first flange, said lower casing half having a peripheral edge portion formed as a second flange, said first and second flanges being disposed to mate with one another, means securing said first and second flanges together in said mated position, said front wall of each of said upper and lower casing halves having opposed notched areas which together form an access opening for said person, an inner casing disposed within said outer casing, said inner casing comprising a front panel, rear panel, right panel and left panel disposed inwardly of said front wall, rear wall, right wall and left wall respectively of said upper and lower outer casing halves, said inner casing further comprising a ceiling panel disposed inwardly and underlying said top wall of said upper casing half and a floor panel disposed inwardly and overlying said bottom wall of said lower casing half, said front panel having an opening aligned with and having substantially the same configuration as said access opening in said outer casing, a mat on said bottom panel accommodating said prone person, said inner casing having portions thereof contacting said outer casing such that the overall structural integrity of the bedroom is increased, said inner casing having portions thereof spaced from said outer casing defining utility spaces between said inner and outer casing, and utility means disposed in said utility spaces, said utility means being accessible to the person within said bedroom cabinet.

9. A bedroom cabinet according to claim 8, wherein said utility menas comprises shelves.

10. A bedroom cabinet according to claim 8, wherein said utility means comprises an illuminating device.

11. A bedroom cabinet according to claim 8, wherein said utility means comprises a telephone.

12. A bedroom cabinet according to claim 8, wherein said utility means comprises a radio.

13. A bedroom cabinet according to claim 8, wherein said utility means comprises a television set.

14. A bedroom cabinet according to claim 8, wherein said utility means comprises sound proofing material.

15. A bedroom cabinet according to claim 8, wherein said utility means comprises electrical wiring.

16. A bedroom cabinet according to claim 8, wherein said outer casing is made of a fiber reinforced plastic material.

17. A bedroom cabinet according to claim 8, wherein the outer surface of said upper and lower walls have planar portions which enable two or more bedroom cabinets to be stacked on top of one another.

18. A bedroom cabinet according to claim 8, further comprising a movable screen mounted on said inner casing and disposed to cover said access opening.

19. A bedroom cabinet according to claim 8, further comprising a pair of rollers rotatably mounted in said inner casing, and an elongated sheet having one portion extending over said mat and another portion rolled up on one of said rollers so that said other portion can be rolled off of said one roller to extend over said mat as said one portion is rolled up on said other roller.

20. A bedroom cabinet according to claim 8, wherein said outer casing is provided with at least one recessed area, and a venting opening in said recessed area.

* * * * *